US005239342A

United States Patent [19]

Kubo et al.

[11] Patent Number: 5,239,342

[45] Date of Patent: Aug. 24, 1993

[54] METHOD OF DEVELOPING AN ELECTROSTATIC LATENT IMAGE UTILIZING A TWO-COMPONENT DEVELOPER COMPRISING A MAGNETIC CARRIER AND A TONER

[75] Inventors: Masahiko Kubo, Yao; Akihiro Watanabe, Nara; Takafumi Nagai, Higashi-Osaka; Hironori Maruyama, Kadoma, all of Japan

[73] Assignee: Mita Industrial Co., Ltd., Osaka, Japan

[21] Appl. No.: 904,213

[22] Filed: Jun. 25, 1992

[30] Foreign Application Priority Data

Jun. 28, 1991 [JP] Japan ..... 3-183347

[51] Int. Cl.[5] ..... G03G 15/06

[52] U.S. Cl. ..... 355/245; 118/657; 430/31; 430/122

[58] Field of Search ..... 355/245, 261, 265, 251, 355/253, 77; 118/658, 657, 656, 653; 430/31, 45, 111, 107, 103, 122

[56] References Cited

U.S. PATENT DOCUMENTS

| | | | |
|---|---|---|---|
| 4,844,008 | 7/1989 | Sakemi et al. | 118/658 |
| 4,985,327 | 1/1991 | Sakashita et al. | 430/111 X |
| 4,996,126 | 2/1991 | Anno et al. | 430/111 X |
| 4,999,272 | 3/1991 | Tanikawa et al. | 430/111 X |
| 5,001,517 | 3/1991 | Hosaka et al. | 355/251 X |
| 5,049,470 | 9/1991 | Higashiguchi et al. | 430/122 |
| 5,049,471 | 9/1991 | Higashiguchi et al. | 430/122 |

*Primary Examiner*—A. T. Grimley
*Assistant Examiner*—Sandra L. Brasé
*Attorney, Agent, or Firm*—Sherman and Shalloway

[57] ABSTRACT

The present invention provides a developing method which comprises transferring a two-component developer comprising a magnetic carrier and a toner from a sleeve to a development area and developing a latent electrostatic image on a latent electrostatic image-carrier in the development area, wherein the development conditions in the development area are prescribed so as to satisfy the formulae (1) and (2):

$$140 \geqq R \times (S/D) \geqq 50 \quad (1)$$

and $$R = M(Wt \times (1/\rho t) + Wc \times (1/\rho c))/H \quad (2)$$

wherein S is the peripheral speed (cm/sec) of the development sleeve, D is the peripheral speed (cm/sec) of the latent electrostatic image-carrier, M is the coated amount (g/cm$^2$) of the developer per unit area of the sleeve, H is the distance (cm) at which the sleeve most approaches a drum of a photosensitive material, Wt is the weight concentration (%) of the toner in the developer, Wc is the weight concentration (%) of the carrier in the developer, $\rho t$ is the true density (g/cm$^3$) of the toner, and $\rho c$ is the true density (g/cm$^3$) of the carrier.

6 Claims, 3 Drawing Sheets

METHOD OF DEVELOPING AN ELECTROSTATIC LATENT IMAGE UTILIZING A TWO-COMPONENT DEVELOPER COMPRISING A MAGNETIC CARRIER AND A TONER

BACKGROUND OF THE INVENTION

1. Field of the Invention

This invention relates to a method of development in a high density in electrophotography, and particularly to a development method of a two-component system directed to the prevention of toner scattering, the prevention of carrier drop off, the increasing of reproducibility of a dot image and the increasing of an image density.

2. Description of the Prior Art

A two-component type developer containing a magnetic carrier and a toner is widely used in commercial electrophotographic copying machines. In developing a charged image, a magnetic brush having this developer is formed on a development sleeve equipped with magnetic poles inside, and it is caused to slide with a photosensitive material having this charged image to form a toner image.

The requirement that in this two-component developer, a sufficient image density should be obtained without toner scattering and these characteristics should be maintained for a long period of time is determined by the affinity between the toner and the carrier.

As a general tendency, when the concentration of the toner becomes high, a high image density is obtained. But the triboelectricity of the toner tends to become insufficient, and the toner has a reduced ability to bind with the carrier. Furthermore, since the going and incoming of the toner in the developer become violent, the tendency of toner scattering is recognized to increase. For this reason, the conventional two-component development method is carried out at a lower toner concentration. But the development efficiency is generally low and the image density at the solid portion tends to be low.

If the charging properties of the toner and the carrier in the two-component developer are sufficient, it is expected that when the density of the toner is high, the image density is high and toner scattering becomes low. This is almost impossible of realization with a commercial toner or development method. In the toner production, poor toner particles containing no charge controlling agent or a little charge controlling agent will be formed necessarily with a certain probability, and during development, a charge controlling agent will be lost with a mechanical force in and outside a developer, or toner particles with a reduced content of the charge controlling agent will be formed with a certain frequency. Furthermore, since the area ratio of the document changes or the environment changes, the toner contains uncharged toner particles to which necessary charging cannot be given. Therefore, toner scattering necessarily takes place and this leads to the fouling of the inside of the copying machine or the fouling of the copied products.

The present inventors found that a developer comprising a two-component type developer comprising a magnetic carrier and a toner has a keypoint in the flowing state of the developer which passes a development area, and by setting development conditions within a certain range in regard to the flowing state, toner scattering can be effectively prevented even when the density of the toner is relatively high and the toner contains poorly charged particles. The inventors proposed it in Japanese Laid-Open Patent Publication No. 170953/1991.

The above proposal is generally satisfactory for the object of preventing toner scattering, and increasing the image density in a solid portion, but has still a problem in regard to the reproducibility of fine line images or dot images (digital images obtained by radar exposure) or carrier scattering.

In the above proposal, the developer is fed in a relatively sparse condition into a developing area. The image density in the solid portion increases but in the fine line portions or dot portions, images become thickened or toner scattering tends to occur. Furthermore, carrier scattering takes place, and the particle size or particle size distribution of the carrier tends to be not in accordance with actual operating conditions.

SUMMARY OF THE INVENTION

Accordingly, it is an object of this invention to eliminate the defects of the above-mentioned development system using a two-component developer comprising a magnetic carrier and a toner, and to provide a development method which increases the reproducibility of fine line images or dot images, prevents toner scattering and carrier scattering, inhibits the occurrence of fogs, and markedly increases the density of images.

According to this invention, there is provided a development method which comprises transferring a two-component developer comprising a magnetic carrier and a toner from a developer device to a development area by a sleeve, developing a latent electrostatic image on a latent electrostatic image-carrier in the development area and circulating the spent developer to the developing device, wherein the developing conditions in the developing zone are prescribed so as to satisfy the formulae (1) and (2):

$$140 \geqq R \times (S/D) \geqq \quad (1)$$

and $$R = M(Wt \times (1/\rho t) + Wc \times (1/\rho c)/H \quad (2)$$

wherein S is the peripheral speed (cm/sec) of the development sleeve, D is the peripheral speed (cm/sec) of the latent electrostatic image-carrier M is the coated amount (g/cm$^2$) of the developer per unit area of the sleeve, H is the distance (cm) at which the sleeve most approaches a drum of a photosensitive material, Wt is the weight concentration (%) of the toner in the developer, Wc is the weight concentration (%) of the carrier in the developer, $\rho t$ is the true density (g/cm$^3$) of the toner, and $\rho c$ is the true density (g/cm$^3$) of the carrier, and the magnetic carrier has an average particle diameter of 60 to 70 $\mu$m, and the magnetic carrier has such a particles size distribution that a particle diameter of not more than 44 $\mu$m occupies 3 to 15% by weight of the entire magnetic carrier.

In the present invention, the position of the main pole of a development magnet inside the development sleeve is placed more in upstream of the sleeve rotation direction than a position at which the latent electrostatic image-carrier and the development sleeve most approach, and development is carried out so that a region in which the magnetic flux density decreases towards the downstream direction of the sleeve rotation direction in the magnetic flux density of the main pole is opposed to a position at which the latent electrostatic image-carrier and the development sleeve most approach. More preferably, the development is carried out while an alternating voltage forming an alternating field between the maximum potential and the minimum potential of the latent electrostatic image with the same polarity as the latent electrostatic image is impressed between the development sleeve and the latent electrostatic image-carrier.

Moreover, it is preferred that the development should be carried out while the main pole of the development magnetic pole is positioned by 2 to 30 degrees in the upstream side of the rotating direction of the sleeve apart from a straight line formed by connecting the center of the drum of the latent electrostatic image-carrier and the center of the development sleeve.

DETAILED DESCRIPTION OF THE DRAWINGS

Figure 1:
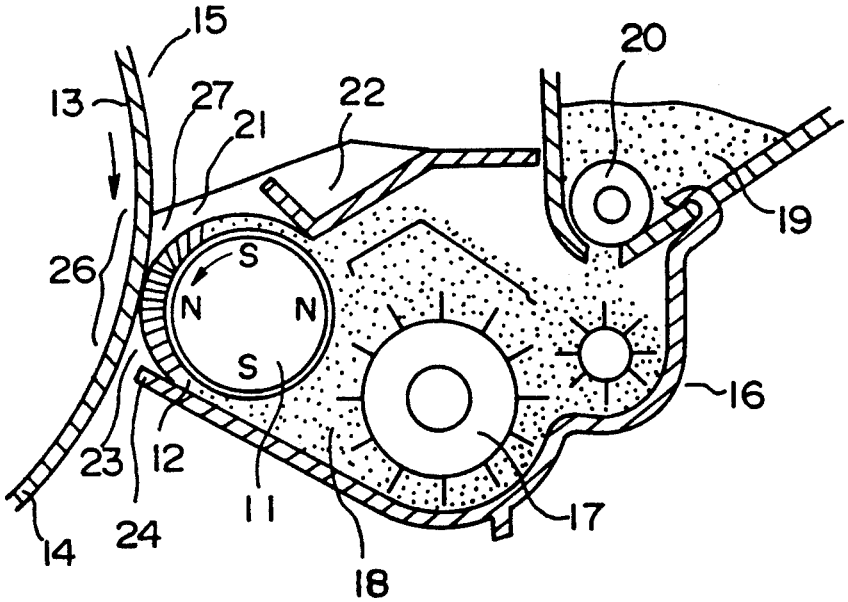
FIG. 1 is a side elevational view illustrating the method of development by using a magnetic brush used in this invention.

In accordance with this invention, the development conditions are set so as to satisfy the formulae (1) and (2), namely to satisfy the peripheral speed (S; cm/sec) of the development sleeve, the peripheral speed (D; cm/sec) of the latent electrostatic image carrier, the coated amount (M; g/cm$^2$) of the developer per unit area of the sleeve, the distance (H; cm, also called drum-sleeve distance, or D-S distance) at which the sleeve most approaches a drum of a photosensitive material, the weight concentration (Wt) of the toner in the developer, the true density ($\rho t$; g/cm$^3$) of the toner, the weight concentration (Wc) of the carrier, and the true density ($\rho c$; g/cm$^3$) of the carrier as set out in formulae (1) and (2); and the magnetic carrier is used to have an average particle diameter of 60 to 70 $\mu$m, and such a particle size distribution that a particle diameter of not more than 44 $\mu$um occupies 3 to 15% by weight of the entire magnetic carrier. By the setting of the former development condition, the flow state of the two-component developer, the feed speed of the developer and a sliding condition of the latent electrostatic image carrier in the development region are markedly improved. Even under development conditions in which the image density becomes high, toner scattering and carrier adhesion are effectively inhibited. Furthermore, by the selection of the carrier particle size, reproducibility of fine line images or dot images is increased and toner scattering and carrier scattering can be prevented. In addition, the density of images can be markedly increased. Furthermore, it is surprising that the development conditions can be set mildly so that they cope with the actual operating conditions.

R defined in (2) is a dimensionless number, and shows a volume ratio (%) of the two-component developer in the volume of the development area. As the R (occupation ratio of the developer) value is greater, the developer is more tightly filled in the development area. On the other hand, (S/D) in formula (1) is the ratio of the peripheral speed of the development sleeve per peripheral speed of the latent electrostatic image-carrier. The larger this value, the larger the supply of the developer. If the product (Z; this value can be said to be a developer substitution degree based on the volume of the development area) of the developer occupying ratio (R) multiplied by the sleeve/carrier peripheral ratio (S/D) is prescribed at 50 to 140 (%), it is possible to effectively prevent toner scattering, increase the image quality and the density of the image and prevent carrier adhesion.

If the developer substitution degree (Z) is smaller than 50%, the amount of the toner supplied becomes small and the density of the image is decreased. Furthermore, the volume of the developer in the D-S development area decreases, and the magnetic brush in this area entails air from above the valley between D-S and transports it below the valley between D-S, to develop an air current. Thus, together with an air current inside and outside the developing machine, it scatters toner together with the air current and tends to develop a fog. On the other hand, if the developer substitution degree (Z) exceeds 140%, a sliding force between the developer and the latent electrostatic image-carrier becomes too great and the developer is filled too much in the valley between D-S and the developer does not flow smoothly. The developer gives a large load on the development sleeve, and the rotation of the sleeve cannot be performed smoothly. As a result, a disturbance is given to the developer, and toner scattering is liable to take place above the valley. This causes toner scattering to be liable to take place, and the developer is choked up. Furthermore, the image is disturbed (forward end lacking, backward end lacking, formation of a brush mark), and the carrier adheres. On the other hand, within the ranges specified in this invention, the developer flows smoothly through the valley between D-S in a development area and a sufficient amount of the toner is supplied. Thus, the occurrence of the air current is prevented and toner scattering or carrier adhesion and the disturbance of the image can be effectively prevented. As a result, an image of high quality in a high density is formed.

In the present invention, the relations between the developer substitution degree (Z) and the various factors of the development conditions will be clear from the formulae (1) and (2). The developer substitution degree (Z) is proportional both to the developer occupying ratio (R) and the peripheral speed ratio of the development sleeve and the image carrier (S/D). As the coated amount M of the developer on the sleeve becomes large, R increases. Furthermore, when the D-S distance H becomes great, R is small. Since generally $\rho t < \rho c$, the developer occupying ratio increases as the toner concentration (weight concentration in the two-component developer becomes high.

In the present invention, it is critical for the object of this invention to use a magnetic carrier having an average particle diameter of 60 to 70 $\mu$m and such a particle size distribution that a particle diameter of not more than 44 $\mu$m occupies 3 to 15% by weight of the entire magnetic carrier.

In the present application, the average particle diameter of the magnetic carrier is measured by a mesh method, and corresponds to a weight basis median diameter (D50).

It was found that with regard to the movement of the developer or the toner not only the aforesaid developer filling ratio but also the particle diameter of the magnetic carrier gives a serious influence. The use of a magnetic carrier having the above average particle diameter softens the movement of the developer. In addition, the movement of the toner is smooth, and the increase in the reproducibility of fine lines or dot images or the increase of density can be attained. Under the development condition defined by the formula (1), the adhesion and scattering of the carrier tend to occur, but the use of the magnetic carrier having the above average particle diameter can inhibit the adhesion and scattering of the carrier.

If the average particle diameter is at least 70 μm, the formability of an image in a high density and the reproducibility of a dot image become aggravated even under the development condition satisfying the formula (1). On the other hand, if the average particle diameter is 60 μm or less, carrier adhesion occurs even under the development condition satisfying the formula (1).

When the particle size distribution is a normal distribution, the average particle diameter of the carrier corresponds to its peak particle diameter. It has been found however that the distribution of a fixed small particle diameter side affects the density of the image or carrier adhesion. Investigations of the present inventors show that in the magnetic carrier of the above average particle diameter, the content of particles having a particle diameter of 44 μm or less gives a serious influence to the length of the magnetic brush or the breakableness of the brush length under a dynamic development condition. With a carrier having a small particle diameter distribution, the magnetic brush is cut under a dynamic condition to such a degree that the supply of the toner or the movement of the toner is carried out smoothly. The cutting of the magnetic brush to such a degree that the carrier scatters and adheres can be inhibited even under a dynamic condition.

Actually, with a magnetic carrier having a particle distribution in which the content of the particles of not more than 44 μm is less than 3%, a sufficiently satisfactory image density cannot be obtained even if the other conditions satisfy the ranges defined by this invention. Furthermore, with a magnetic carrier having such a particle diameter distribution that the content of particles of not more than 44 μm is more than 15%, carrier adhesion occurs even if the other conditions satisfy the ranges defined by this invention.

Development Device

In FIG. 1 for illustrating the magnetic brush developing method used in this invention, a magnet roll (development magnet) 11 equipped with a number of magnetic poles N and S is accommodated in a development sleeve 12 composed of a non-magnetic material such as aluminum. From a slight space, H, from the development sleeve 12, a photosensitive drum (image-carrier) composed of a base body 13 and an electrophotographic photosensitive layer 14 is provided. The development sleeve 12 and the photosensitive drum 15 are rotatably secured on a machine frame (not shown), and are driven so that the moving directions (arrows) at the nip position are the same direction (the rotating directions are opposite to each other). The development sleeve 12 is positioned in the opening portion of a developing device 16. Inside the developing device 16, a mixer-stirrer 17 of a two-component developer (a mixture of a toner and a magnetic carrier) 18. Above the mixer-stirrer 17, a toner supplying mechanism 20 for supplying the toner 19 is provided. The two-component developer 18 is mixed in the stirrer 17 to triboelectrically charge the toner, then supplied to the development sleeve 12 thereby to form a magnetic brush 21 on its surface. This magnetic brush 21 is adjusted in brush length by a brush length-cutting mechanism 22, and transported to the nipping position (develop-ing area) 26 with the electrophotographic photosensitive layer 14 and a latent electrostatic image on the photosensitive layer 14 is formed into a visible image by the toner 19.

The development sleeve 12 is positioned in an opening portion (shown on the whole 23) of the developer device. In the supply portion of the development sleeve, the brush length-cutting mechanism 22 is arranged. On the circulating side of the sleeve toward the developer device, a developer-receiver 25 having an opening end edge 24 is provided.

When the developer 22 passes the brush-length cutting mechanism 22 and arrives at a development area 26, the volume of the developer in the development area becomes small as the developer occupying ratio R in this area decreases. The magnetic brush 21 formed in this area sucks air from above a valley 27 between the development sleeve 12 and the image-carrier drum 15 and tends to transport it under the valley between the development sleeve 12 and the image-carrier drum 15 and to form an air current. The toner scatters together with the air current within the machine (not shown) outside the developer device. If the volume of the developer further decreases, not only toner scattering occurs but also the supplying ability of the toner decreases. Therefore, these defects decrease the image density.

If the developer occupying ratio (R) becomes too large, the developer tends to be filled in the valley 27 between the electrostatic image-carrier drum 15 and the development sleeve 12. Consequently, the developer does not flow smoothly and causes a considerable burden to the development sleeve 12. As a result, the rotation of the sleeve is not smooth and disturbance is given to the developer. Thus, toner scattering occurs and the image is disturbed.

According to the present invention, the peripheral speed ratio of the development sleeve 12/latent electrostatic image-carrier 15, the composition of the developer, the coated amount of the developer and the D-S distance are set out so as to satisfy the formula (1). The coated amount M of the developer can be present at a fixed amount by varying the peripheral speed of the sleeve 12, or by adjusting the distance between the sleeve 12 and the brush length-cutting mechanism 22.

In the present invention, development is preferably carried out so that the position of the main pole of the development magnet 11 within the development sleeve 12 is arranged upstream of the rotation direction of the sleeve as compared with the position at which the latent electrostatic image-carrier 15 and the development sleeve 12 most approach, and a region in which the magnetic flux density in the magnetic flux distribution of the main pole decreases downstream of the rotation direction of the sleeve is opposed to a position at which the latent electrostatic image-carrier 15 and the development sleeve 12 most approach, especially while an alternate voltage forming an alternating field between the maximum potential and the minimum potential having the same polarity as the latent electrostatic image is impressed between the development sleeve and the latent electrostatic image-carrier.

Figure 2A:
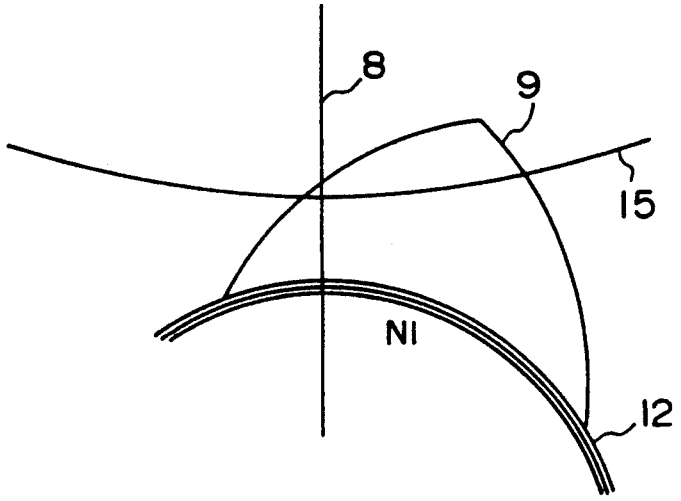
FIG. 2 is a side view showing the development portion of a preferred development method of this invention, (a) showing the magnetic force on the development sleeve, and (b) showing the magnetic brush (developer) arrangement on the magnetic sleeve.
Figure 2B:
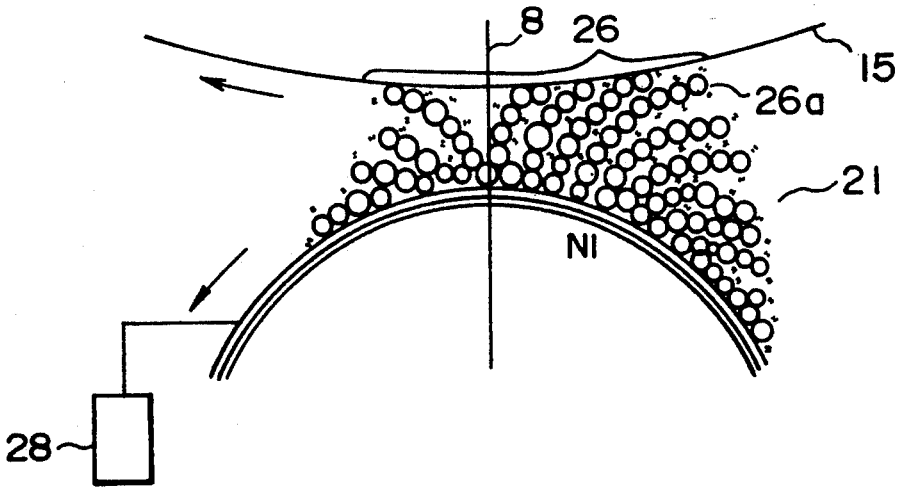

FIG. 2 is a side view expressing an essential portion of the development portion in accordance with a preferred developing method of the invention. (a) shows a magnetic force distribution on the development sleeve, and (b) shows an arrangement of magnetic brushes (developer) on the development sleeve. In the drawing, the development sleeve 12 and the latent electrostatic image-carrier 15 are arranged so that they most approach at the position of a straight line 8, and both. are rotating in the arrow direction. Development (sliding) is carried out so that the magnetic brush (developer) 21 formed corresponding to the magnetic force distribution 9 of the main pole N1 of the development magnet has the highest brush height at a development beginning (sliding beginning) position 26*a* of the development area 26, and the magnetic brush height gradually decreases.

As a result, in comparison with the prior art, the development beginning position 26*a* can be brought to a considerably upstream side of the rotation direction of the latent electrostatic image-carrier. Furthermore, since the brush length height decreases gently, a sliding area in which the magnetic brush comes into sliding contact with the latent electrostatic image-carrier can be prolonged. As a result, wind up of the air current can be effectively prevented and even at a lowered peripheral speed of the sleeve, the toner can be supplied fully. Furthermore, an alternating voltage forming an alternate electric field between the maximum potential and the minimum potential of the latent electrostatic image is impressed on the development sleeve 12 by a power supply 28. While acting together with the decrease of the magnetic flux, the individual brushes in the magnetic brushes moves slightly and broaden the degree of freedom with the progress of sliding. The sliding pressure of the magnetic brushes decrease and the unwanted toner scattered in the non-image part is picked up. Thus, the localization of the line image, the formation of a brush mark by the magnetic brushes and the scattering of the toner in the non-image portion (especially, near the dot surrounding portion) can be inhibited.

Figure 3:
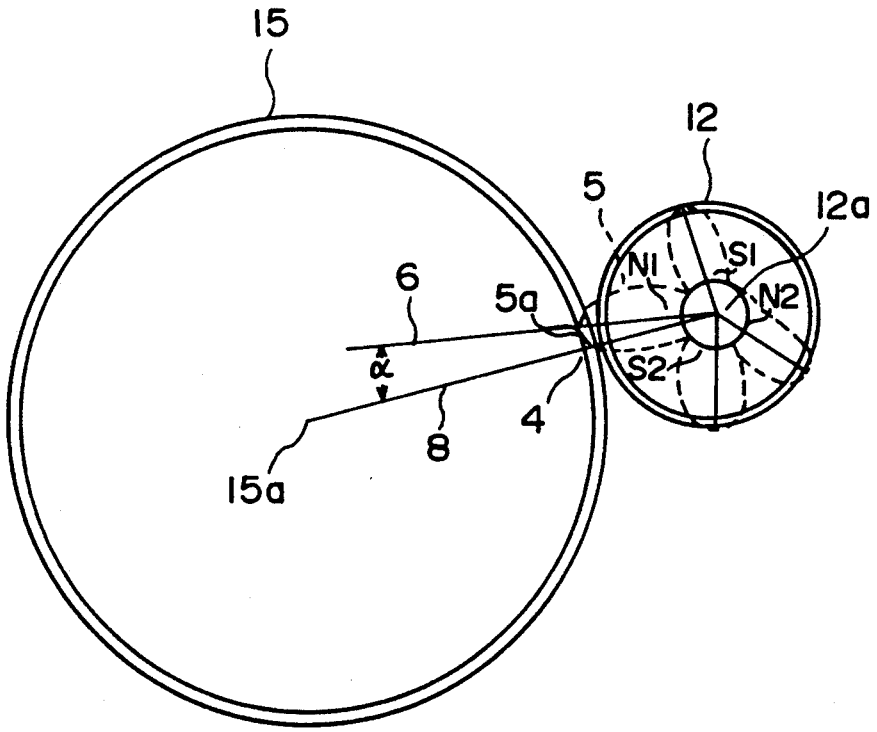
FIG. 3 is an arrangement view showing a preferred positional relationship of the development sleeve and the image-carrier in the development region in this invention.

FIG. 3 is an arrangement view showing a preferred positional relation of the development sleeve and the image-carrier in the development are in this invention. The position of the main pole N1 in the development sleeve 12 is prescribed so that a straight line 6 connecting the main pole N1 and the center 12*a* of the development sleeve 12 is deviated upstream in the sleeve rotating direction by a predetermined angle ($\alpha$) as compared with a straight line 8 connecting the center 12*a* of the latent electrostatic image-carrier 15 and the center 12*a* of the development sleeve 12. An area 5*a* in which the magnetic flux density of the magnetic force distribution 5 of the main pole N1 is opposed to a position 4 which most approaches the image-carrier 15. The degree by which the main pole N1 of the development magnet within the development sleeve is moved upstream of the rotating direction of the sleeve differs depending upon the diameter of the development sleeve or its rotation speed, but when the diameter of the development sleeve is 9 to 50 mm, generally $\alpha$ is 2 to 30 degrees, preferably 8 to 20 degrees. The above developer occupying ratio (R) is preferably 30% to 75%. If this angle ($\alpha$) is less than 2 degrees, it is difficult to improve the quality of the image and elarge the effective developer occupying ratio. If the angle ($\alpha$) is larger than 30 degrees, the sliding area is narrowed, and the image density is liable to decrease.

As the development sleeve, a development sleeve known per se is used. Stainless steel and aluminum may be used as a material of the development sleeve. Especially, aluminum sand-blasted is preferred in view of the transferability of the developer.

The development magnetic poles in the development sleeve may be an N1 pole as a development main pole, an S1 pole as a brush length-cutting pole, an N2 pole as a draw-up pole, a 4-pole type equipped with a developer recovery pole as an S2 pole or a 5-pole type further having a pole playing the role of exchanging a developer as shown in FIG. 3. These development magnetic poles are composed of a magnetic field-generating means such as a permanent magnet and an electromagnet. It is fixed and arranged at the position shown in the drawing.

The magnetic flux density of the main pole N1 of the development magnet is 600 to 1200 gauss, especially from the viewpoint of image quality 700 to 1000 gauss. Other magnetic poles are properly selected from those having 500 to 1000 gauss, especially those having 650 to 850 gauss.

Magnetic brush length-cutting mechanism may be provided at a position between the S1 pole and the N1 pole in FIG. 3 by considering the stability to the error in assembling the pole angles. The brush length depends upon the magnetic flux density but is suitably 0.5 to 1.8 mm, preferably 0.6 to 1.6 mm.

The alternating current voltage value impressed on the development sleeve may be one having a peak voltage between the maximum potential and the minimum potential of the latent electrostatic image. Particularly, 60 to 90% of the difference between the maximum potential and the minimum potential may be used as a criterion. Together with an alternating current voltage, a direct current voltage may be impressed. In this case, a potential which is 10 to 120% of the maximum potential of the latent electrostatic image having the same polarity as the latent electrostatic image may be selected.

The peripheral speed difference of the latent electrostatic image-carrier and the development sleeve will affect the coated amount of the developer on the development sleeve and the sliding pressure on the latent electrostatic image-carrier by the magnetic brush. By considering this effect, the peripheral speed difference may be present at 30 to 600 mm/sec., especially 60 to 300 mm/sec.

Magnetic Carrier

A magnetic carrier having an average particle diameter of 60 to 70 $\mu$m and such a particle size distribution that a particle diameter of not more than 44 $\mu$m occupies 3 to 14% by weight of the entire magnetic carrier may be used in this invention. The density of the magnetic carrier depends upon the carrier concentration Wc, but generally the density ($\rho c$) should be 3.50 to 6.50 g/cm$^3$, especially 4.00 to 5.50 g/cm$^3$. Magnetic carriers known per se may be used, for example, tri-iron tetroxide, ferrite, and iron powder. Especially, ferrite-type magnetic carriers are preferred.

The saturation magnetization of the carrier is 30 to 70 emu/g, preferably 53 to 65 emu/g. As the magnetic carrier, a ferrite carrier satisfying the above conditions, and especially a spherical magnetic carrier are preferred. Its particle size distribution satisfies the above conditions, preferably a normal distribution or a distribution near it. The carrier may be a non-coated carrier, or resin-coated carriers coated with a known resin such as a silicone resin, an acrylic resin, an epoxy resin, or a fluorine resin.

The electric resistance of the ferrite carrier of course various depending upon the chemical composition, but also varies also according to the structure of the particles, the method of production, or the type or thickness of the coating. Generally, the volume inherent resistivity may be $5\times10^8$ to $5\times10^{11}$ Ω·cm, especially $1\times10^9$ to $1\times10^{11}$ Ω·cm.

Toner

The toner used in this invention may be any known toner having electroscopic property, colorability and fixability. It is prepared by adding a colorant and a charge controlling agent or another known toner compounding agent to a fixing resin binder. This toner has a density ρt of 1.00 to 1.40 g/cm$^3$, especially preferably 1.10 to 1.20 g/cm$^3$.

In the present invention, the toner has a particle size of generally 5 to 30 μm. EspecialIY, in the present invention, the toner desirably has an average particle diameter of 8 to 10 μm and such a particle size distribution that ½ or less of the average particle diameter is not more than 3% by weight of the entire toner particles. By using such a toner, the resolution is further increased and the scattering of the toner in the circumferential portion of the image can be markedly inhibited.

In the present specification, the average particle diameter of the toner refers to one measured by a Coulter counter method, and corresponds to a volume median diameter (D'50).

The toner used in this invention preferably has a volume inherent resistivity of $1\times10^8$ to $3\times10^{10}$ Ω·cm, especially $2\times10^8$ to $8\times10^9$ Ω·cm. Preferably, it has a dielectric constant of 2.0 to 4.5, especially 2.5 to 3.5.

The fixing resin binder for the toner, the colorant, the charge controlling agent and other toner additives may be selected and combined so that the above characteristics can be obtained.

Thermoplastic resins and thermosetting resin in the form of non-setting type or an initial condensation product may be used as the fixing resin binder. Examples include vinyl aromatic resins such as polystyrene, acrylic resins, polyvinyl acetal resins, polyester resins, epoxy resins, phenolic resin, petroleum resins, and polyolefin resins. Of these, the styrene-type resins, the acrylic resins and a styrene-acrylic copolymer resin are preferably used.

Inorganic or organic pigments or dyes may be used alone or as a mixture of two or more as shown below but not limited to these. Examples include carbon blacks such as furnace black and channel black, iron black such as tri-iron tetroxide, titanium dioxide of the rutile type or anatase type, Phthalocyanine Blue, Phthalocyanine Green, Cadmium Yellow, Molybdenum Orange, Pyrazolone Red, and Fast Violet B.

Known conventional charge controlling agents may be used. For example, they include oil-soluble dyes such as nigrosine base (CI50415), oil black (CI20150) and spiron black, 1:1 type or 2:1 type metal complex salt dyes, metal naphthenates, fatty acids, soaps, and resin acid soaps.

The particle shape may be irregularly-shaped produced by melt kneading and pulverization, or spherical obtained by a dispersion or suspension polymerization method.

Developer

The toner weight concentration Wt of the developer may generally be 3 to 8%, particularly 3.5 to 7.5%. The electric resistance of the entire developer may be in the range of $1\times10^9$ to $1\times10^{11}$ Ω·cm, particularly $5\times10^9$ to 5 $10^{11}$ Ω·cm.

Other Development Conditions

The most approaching distance between the development sleeve and the latent electrostatic image-carrier, D-S distance (H), may be selected from 0.04 to 0.2 cm, particularly 0.06 to 0.1 cm.

The photosensitive material is used any one used in conventional electrography, for example it may include a selenium photosensitive material, an amorphous silicon photosensitive material, a zinc oxide photosensitive material, a cadmium selenide photosensitive material, a cadmium sulfide photosensitive material, and various organic photosensitive materials.

According to this invention, in carrying out development using a magnetic brush of a two-component developer composed of a magnetic carrier and a toner, development conditions, such as the peripheral speed ratio of the development sleeve/latent electrostatic image-carrier, the composition and density of the developer, the coated amount of the developer, and the drum-sleeve distance, are selected from the ranges shown in formula (1), and a magnetic carrier having an average particle diameter of 60 to 70 μm and such a particle size distribution that a particle diameter having not more than 44 μm occupies 3 to 15% by weight of the entire magnetic carrier is used. This leads to a marked improvement in the flowing state of the two-component developer in the development area, the supplying condition of the toner, and the sliding condition of the developer. Furthermore, toner scattering or the disturbance of images can be effectively inhibited. The selection of the carrier particle diameter increases the reproducibility of images such as fine lines or dots, prevents toner scattering and carrier scattering, and markedly improves the image density. In addition, surprisingly, the setting of the development conditions is made mild so as to accord with actual operating conditions.

EXAMPLES

The invention will be specifically illustrated by the following examples.

The development conditions were as follows:

The distance H at which the image-carrier most approaches the sleeve: 0.07 cm

The strength of the main pole: 980 gauss

The inclination angle α of the main pole: 15°

The potential of the latent electrostatic image: 31 700 V to −85 V

Development bias potential:

DC voltage −400 V

AC voltage −400 V

Under the above development conditions, a developer having a toner having an average particle diameter of 9.5 μm and 1.3% by weight of particles with not more than 4.75 μm, a true toner density ρt of 1.1 g/cm$^3$, and a toner weight concentration Wt of 4.1% (the weight concentration Wc of the carrier was 95.9%) was used. The average carrier particle diameter and the content of carrier particles having a particle diameter of not more than 44 μm were varied, and furthermore, while varying the peripheral speed of the development sleeve, S (cm/sec), the peripheral speed D (cm/sec) of the image-carrier, and the coated amount M (g/cm$^2$) per unit area of the development sleeve, image formation was carried out.

The method of evaluating the image in the copied product

Image density (ID) was measured by a densitometer (a product of Sakura Co., Ltd.). ID of at least 1.80 is preferred and expressed by ○. ID of less than 1.80 is shown by ×.

Dot reproducibility shows toner scattering in the circumferential part (non-image part) of the dot by a polarizing microscope (Nikon OPTIPHOT=POL) relatively with eye view judgment. ○ shows small toner scattering and a good result. × shows toner scattering is violent and a poor result.

A fog and carrier adhesion were judged with eye view on the copied product and the inside of the copying machine. ○ showed that no fog or carrier adhesion was noted and the result was good. × showed that a fog and carrier adhesion were ascertained by the eye view, and the result was poor.

The results are shown in Table 1.

TABLE 1

| | Particle size of the carrier (μm) | * | Z (R × S/D) | R | M | S/D | ID | Dot reproducivility | Carrier adhesion | Fog |
|---|---|---|---|---|---|---|---|---|---|---|
| Example | | | | | | | | | | |
| 1 | 65 | 3.0 | 50 | 33.3 | 0.102 | 1.5 | ○ | ○ | ○ | ○ |
| 2 | 65 | 8.2 | 81 | 40.6 | 0.124 | 2.0 | ○ | ○ | ○ | ○ |
| 3 | 65 | 15.0 | 140 | 56.0 | 0.171 | 2.5 | ○ | ○ | ○ | ○ |
| Comparative Example | | | | | | | | | | |
| 1 | 65 | 1.1 | 81 | 40.6 | 0.124 | 1.5 | X | ○ | ○ | ○ |
| 2 | 65 | 2.2 | 81 | 40.6 | 0.124 | 2.0 | X | ○ | ○ | ○ |
| 3 | 65 | 16.5 | 81 | 40.6 | 0.124 | 2.0 | ○ | ○ | X | ○ |
| 4 | 65 | 18.3 | 81 | 40.6 | 0.124 | 2.0 | ○ | ○ | X | ○ |
| 5 | 65 | 6.4 | 41 | 40.6 | 0.124 | 1.0 | X | ○ | ○ | ○ |
| 6 | 65 | 6.4 | 49 | 40.6 | 0.124 | 1.2 | X | ○ | ○ | ○ |
| 7 | 65 | 6.4 | 46 | 30.7 | 0.094 | 1.5 | X | ○ | ○ | ○ |
| 8 | 65 | 8.2 | 142 | 40.6 | 0.124 | 3.5 | ○ | X | X | X |
| 9 | 65 | 8.2 | 162 | 40.6 | 0.124 | 4.0 | ○ | X | X | X |
| 10 | 65 | 11.5 | 147 | 58.9 | 0.180 | 2.5 | ○ | X | X | X |
| 11 | 65 | 6.5 | 177 | 58.9 | 0.180 | 3.0 | ○ | X | X | X |
| 12 | 55 | 5.2 | 81 | 40.6 | 0.124 | 2.0 | ○ | ○ | X | ○ |
| 13 | 75 | 6.5 | 129 | 40.6 | 0.124 | 3.0 | X | X | ○ | ○ |
| 14 | 85 | 7.2 | 61 | 40.6 | 0.124 | 1.5 | X | X | ○ | ○ |
| 15 | 95 | 4.8 | 81 | 40.6 | 0.124 | 2.0 | X | X | ○ | ○ |

*Carrier particles having a weight % of not more than 44 μm.

It is clear from Table 1 that in Examples 1 to 3 using the development method of this invention, an image having a high density can be attained while inhibiting carrier adhesion and formation of a fog and performing the reproducibility of a dot image.

In comparison with Comparative Examples 1 and 2 in which the average particle diameter of the carrier was not more than 60 to 70 μm and particles having not more than 44 μm were less than 3% by weight of the entire carrier particles, the image density is decreased. In Comparative Examples 3 and 4 in which the carrier particles with more than 15% by weight of the entire carrier, carrier adhesion occurs.

In Comparative Examples 5 to 7 in which R×S/D is smaller than 50, the image density is lowered. In Comparative Examples 8 to 11 in which R×S/D is more than 140, the reproducibility of a dot image is poor, and carrier adhesion and fogs occur.

In Comparative Example 12 in which the average particles diameter is less than 60 μm, carrier adhesion occurs, and in Comparative Examples 13 to 15 in which it is larger than 70 μm, the image density is descreased, and the reproducibility of a dot image becomes poor.

EXAMPLE 4

When the inclination angle α of the main pole in the development conditions ws broadened to 20°, 25°, 30°, and 35°, an image density ws decreased at 35°.

EXAMPLE 5

Under the development conditions in Example 1, the inclination angle α was narrowed to 10°, 5°, and 0°, toner scattering, fog formation and a sweeping track of the magnetic brush (brush mark) were noted at 0°.

What is claimed is:

1. A method for developing a latent electrostatic image comprising:

providing a developing device containing a two-component developer, said two-component developer comprising a magnetic carrier and a toner, said toner being present in said developer at a weight concentration of Wt %, said carrier being present in said developer at a weight concentration of Wc %, said toner having a true density of ρt g/cm$^3$, said carrier having a true density of ρc g/cm$^3$, said magnetic carrier having an average particle diameter of 60 to 70 μm, said magnetic carrier having such a particle size distribution that a particle diameter of not more than 44 μm occupies 3 to 15% by weight of the entire magnetic carrier;

providing a rotatable photo-sensitive drum having a latent electrostatic image on a peripheral surface thereof;

providing a rotatable sleeve, intermediate said developing device and said photo-sensitive drum, said rotatable sleeve having a peripheral surface which is separate from the peripherial surface of said rotatable photo-sensitive drum at their closest approach to one another by a distance of H cm;

providing at least one magnetic pole within said rotatable sleeve to form a magnetic brush comprising said two-component developer on said peripheral surface of said rotatable sleeve, said magnetic bursh providing a coated amount M g/cm$^2$ of developer on said peripheral surface of said sleeve, said magnetic brush slidably contactable with said photosensitive drum;

rotating said photosensitive drum in a first direction at a peripheral speed of D cm/sec;

rotating said rotatable sleeve in said first direction at a peripheral speed of S cm/sec to transfer toner from said magnetic brush to said latent electrostatic image on said peripheral surface of said photo-sensitive drum;

setting said peripheral speed of said photosensitive drum and said peripheral speed of said rotatable sleeve so as to satisfy the relationship $$140 \geqq R \times (S/D) \geqq 50$$

wherein $$R = M(Wt \times (1/\rho t) + Wc \times (1/\rho c))/H$$

and S, D, M, Wt, $\rho$t, Wc, $\rho$c and H are as defined above.

2. The method according to claim 1, wherein a main pole of said at least one magnetic pole within said rotatable sleeve is arranged more upstream in said first direction of rotataion than a position at which said photosensitive drum most closely approaches said rotatable sleeve and said toner transfer is carried out so that an area in which a magnetic density in a magnetic flux distribution of said main pole decreases downstream in said first direction is opposed to a position at which said photosensitive drum most closely approaches said rotatable sleeve.

3. The method according to claim 1, wherein toner transfer is carried out while an alternating current forming an alternating electric field is impressed between said rotatable sleeve and said photosensitive drum, siad alternating electric field alternating between a maximum potential and a minimum potential of said latent electrostatic image with a same polarity as said latent electrostatic image.

4. The method according to claim 1, wherein toner transfer is carried out while impressing a direct current voltage between said rotatable sleeve and said photosensitive drum.

5. The method according to claim 1, wherein a main pole of said at least one magnetic pole within said rotatable sleeve is separated 2° to 30° upstream of said first direction from a straight line connecting a center of said photosensitive drum and a center of said rotatable sleeve.

6. The method according to claim 1, wherein said toner has an average particle diameter of 8 to 10 $\mu$ and a particle size distribution such that particles with not more than the average particle diameter occupy not more than 3% by weight of the entire toner.

* * * * *